US006400799B1

(12) United States Patent
Andrews

(10) Patent No.: US 6,400,799 B1
(45) Date of Patent: Jun. 4, 2002

(54) X-RAY TUBE COOLING SYSTEM

(75) Inventor: Gregory C. Andrews, Sandy, UT (US)

(73) Assignee: Varian Medical Systems, Inc., Palo Alto, CA (US)

( * ) Notice: Subject to any disclaimer, the term of this patent is extended or adjusted under 35 U.S.C. 154(b) by 0 days.

(21) Appl. No.: 09/351,579

(22) Filed: Jul. 12, 1999

(51) Int. Cl.[7] ..... H01J 35/10

(52) U.S. Cl. ..... 378/141; 378/121; 378/119

(58) Field of Search ..... 378/119, 121, 378/140, 141, 142, 130

(56) References Cited

U.S. PATENT DOCUMENTS 5,541,975 A * 7/1996 Anderson et al. ..... 378/130
5,689,542 A * 11/1997 Lavering et al. ..... 378/142
6,115,454 A * 9/2000 Andrews et al. ..... 378/140

* cited by examiner

*Primary Examiner*—David P. Porta
*Assistant Examiner*—Pamela R. Hobden
(74) *Attorney, Agent, or Firm*—Workman, Nydegger & Seeley

(57) ABSTRACT

An improved x-ray tube cooling system is disclosed. The system utilizes a shield structure that is connected between a cathode cylinder and an x-ray tube housing and is disposed between the electron source and the target anode. The shield a plurality of cooling fins to improve overall cooling of the x-ray tube and the shield so as to extend the life of the x-ray tube and related components. When immersed in a reservoir of coolant fluid, the fins facilitate improved heat transfer by convection from the shield to the to the coolant fluid. The cooling effect achieved with the cooling fins is further augmented by a convective cooling system provided by a plurality of passageways formed within the shield, which are used to provide a fluid path to the coolant. In particular, a cooling unit takes fluid from the reservoir, cools the fluid, then circulates the cooled fluid through cooling passages. The coolant is then output from the passageway and directed over the cooling fins. In some embodiments, the passageways are oriented so as to provide a greater heat transfer rate in certain sections of the shield than in other sections. Also disclosed is an improved braze joint for connecting the shield to the x-ray tube housing.

27 Claims, 8 Drawing Sheets

X-RAY TUBE COOLING SYSTEM

BACKGROUND OF THE INVENTION

1. The Field of the Invention

The present invention relates generally to x-ray tubes. More particularly, embodiments of the present invention relate to an x-ray tube cooling system that increases the rate of heat transfer from the x-ray tube to a cooling system medium, thereby significantly reducing heat-induced stress and strain in x-ray tube structures and extending the operating life of the device.

2. The Relevant Technology

X-ray producing devices are extremely valuable tools that are used in a wide variety of applications, both industrial and medical. For example, such equipment is commonly used in areas such as diagnostic and therapeutic radiology; semiconductor manufacture and fabrication; and materials analysis and testing.

While used in a number of different applications, the basic operation of x-ray devices is similar. In general, x-rays, or x-ray radiation, are produced when electrons are produced and released, accelerated, and then stopped abruptly. The basic typical x-ray tube has a cathode cylinder with an electron generator, or cathode, at one end. Electrical power applied to a filament portion of the cathode generates electrons by thermionic emission. A target anode is axially spaced apart from the cathode, and is oriented so as to receive electrons emitted by the cathode. Also present is a voltage source that is used to apply a high voltage potential between the cathode and the anode.

In operation, the high voltage potential is applied between the cathode and the anode, which causes the thermionically emitted electrons to accelerate away from the cathode and towards the anode in an electron stream. The accelerating electrons then strike the target anode surface (or focal track) at a high velocity. The target surface on the anode is composed of a material having a high atomic number, and a portion of the kinetic energy of the striking electron stream is thereby converted to electromagnetic waves of very high frequency, i.e., x-rays. The resulting x-rays emanate from the target surface, and are then collimated through a window formed in the x-ray device for penetration into an object, such as a patient's body. As is well known, the x-rays that pass through the object can be detected and analyzed so as to be used in any one of a number of applications, such as x-ray medical diagnostic examination or material analysis procedures.

A percentage of the electrons that strike the anode target surface do not generate x-rays, and instead simply rebound from the surface. These are often referred to as "backscatter" electrons. In some x-ray tubes, some of these rebounding electrons—still traveling at relatively high velocities—are blocked and collected by a shield structure that is positioned between the cathode and the anode so they do not re-strike the target surface of the anode. This prevents the rebounding electrons from re-impacting the target anode and producing "off-focus" x-rays, which can negatively affect the quality of the x-ray image. Some of the rebounding electrons may also impact the interior of the cathode cylinder.

While the use of such a shield structure may prevent rebounding electrons from re-striking the anode target, its use has resulting in additional problems that can ultimately damage the x-ray tube device, and shorten its operational life. In particular. the high kinetic energy produced by the resulting impact of the rebounding electrons against the shield structure or against the interior of the cathode cylinder generates as a by-product a significant amount of heat. These high temperatures, which are in addition to the high temperatures also being generated at the target anode, cause thermal stresses in the structures (including the cathode cylinder and the shield) and structure joints that can, especially over time, lead to various structural failures in the x-ray tube assembly. Moreover, because the rebounding electrons impact some portions of the cathode cylinder and shield structure with relatively greater frequency than other portions, the heat produced is not evenly distributed. The different heat regions result in varying rates of thermal expansion, resulting in mechanical stresses that can also damage the x-ray tube device, especially over numerous operating cycles. For instance, mechanical stress and strain is induced when the cooler part of the structure resists the expansion of the hotter portion of the structure. The level of stress and strain is relatively insignificant at low temperature differentials. However, non-uniform expansion produced by high temperature differentials induces destructive mechanical stresses and strains that can ultimately cause a mechanical failure in the part. Moreover, these stresses are especially damaging to joints between attached components.

Because such high temperatures can cause destructive thermal stresses and strains in the shield structure, the cathode cylinder, and in other parts of the x-ray device, attempts have been made to minimize thermal stress and strain through the use of various types of cooling systems. However, previously available x-ray tube cooling systems have not been entirely satisfactory in providing effective and efficient cooling—especially in the regions of the shield structure and cathode cylinder.

In order to dissipate the high heat present, x-ray tubes have typically utilized some type of liquid cooling arrangement. In such systems, at least some of the external surfaces of the cathode cylinder are placed in direct contact with a circulating coolant, which facilitates a convective cooling process. Often however, this approach is not satisfactory for cooling an adjacent shield structure, which has a limited external surface area, and, because it is exposed to extremely high temperatures from rebounding electrons, is unable to efficiently transfer significant amounts of heat by convection to the coolant. To address this problem, shield structures have been fashioned with internal cooling passages through which a coolant stream is circulated. Thus, the shield structure gives up heat primarily by convection to the coolant which flows through its interior. This approach has not been entirely satisfactory either. Due to the limited size of such cooling passages, only a limited amount of heat can be absorbed by the coolant, and consequently the shield structure may not be adequately cooled. Thus, x-ray devices of this sort may experience greater failure rates and shorter operating lives due to repeated exposure to higher temperatures and resultant stresses.

Also, in systems of this sort, the coolant must be capable of absorbing significant amounts of heat in order to preclude harmful thermal stresses and strain in the shield structure and cathode cylinder. However, with current designs, the circulated coolant eventually, and often prematurely, experiences thermal breakdown and is no longer able to effectively remove heat from the x-ray tube. Again, this translates into an x-ray device that is more subject to failure and that typically has an overall shorter operating life.

Currently available cooling system designs are lacking in another respect as well. As noted, heat produced within the x-ray tube is not evenly distributed. However, currently available cooling systems are not capable of removing heat from certain higher-temperature areas of the x-ray tube faster than cooler areas. Instead, the rate of heat transfer is fairly constant throughout the x-ray tube in existing systems. As such, those regions that are exposed to higher temperatures are not adequately cooled, and experience a greater failure rate.

There are additional problems in existing x-ray tube designs caused by excessive operating temperatures. In particular, the high operating temperatures are especially destructive to the connection points between the various component parts of the x-ray tube device. For instance, the cathode cylinder is fashioned as a single integral part that must be attached to the shield structure. The shield structure is then affixed to the housing, or "can," that encloses the x-ray tube assembly. Typically, these attachments are accomplished by way of a weld or braze joint. However, in prior art systems, these joints have been implemented in a manner that is especially vulnerable to the thermal and mechanical stresses present, and often fail prematurely. Thus, efficient removal of heat, as well as robust joint attachments between component parts is critical to maintaining structural integrity and increased operating life of the x-ray device.

Thus, there is a need in the art for a cooling system that can be used to efficiently and effectively remove heat from the x-ray tube, and especially in the areas of the cathode cylinder and the adjacent shield structure. Moreover, it would be desirable to have a system that provides sufficient heat removal so as to reduce the amount of thermal and mechanical stresses otherwise present within the cathode cylinder and shield, and that would thereby increase the overall operating life of the x-ray tube and x-ray device. Likewise, the system should prevent heat-related damage from occurring in the materials used to fabricate the cathode cylinder and shield assembly, and should reduce structural damage from occurring between joints and/or attachment points between the various structural components. Joints between components should be more robust, and able to withstand high temperatures. Also, it would be desirable if the system could effectively remove heat at a higher rate from those areas of the system that experience higher temperatures than other portions, and thereby reduce the occurrence of varying thermal regions.

BRIEF SUMMARY AND OBJECTS OF THE INVENTION

It is therefore a general objective of the present invention to provide an improved x-ray tube cooling system that addresses the aforementioned problems in the prior art systems.

More particularly, it is a primary object of the present invention to provide an improved x-ray tube cooling system that enhances the convective and conductive heat transfer from components of the x-ray tube to a cooling system coolant, and that is especially efficient in removing heat generated as a result of back scattered electrons within the x-ray tube.

A related objective of the present invention is to provide a cooling system that reduces temperature levels present within x-ray tube components and the coolant, thereby reducing the incidence of failure within the x-ray tube due to thermal stresses and increasing the overall operating life of the x-ray tube.

Another objective of the present invention to provide an improved x-ray tube cooling system in which coolant is circulated through passages formed within a shield structure so as to more efficiently remove heat by convection from the shield.

Yet another object of the present invention to provide an improved x-ray tube cooling system which utilizes a shield structure that has increased external surface area in contact with the cooling system coolant, thereby improving the efficiency and rate at which heat is removed from the shield structure.

Still another objective of the present invention is to provide a cooling system in which areas of the shield structure that have a higher thermal content are cooled at a rate higher than those portions of the shield structure having a lower thermal content.

Another objective of the present invention is to provide improved brazed joints between structures of the x-ray tube that are better able to withstand the thermal and mechanical stresses present within an operating x-ray tube.

Other objects and advantages of the invention will become apparent upon reading the following detailed description and appended claims, and upon reference to the accompanying drawings.

Briefly summarized, the foregoing objects and advantages are provided with an improved x-ray tube cooling system. A preferred embodiment of the system includes a reservoir containing a liquid coolant that is continuously circulated by way of a heat exchanger device. Disposed within the coolant reservoir is an x-ray tube, which consists of a cathode cylinder having an electron source, such as a cathode head assembly, disposed therein. The x-ray tube is also comprised of an evacuated housing that encloses an anode having a target surface capable of receiving electrons emitted by the electron source. Disposed between the cathode cylinder and the x-ray tube housing is a shield structure. The shield structure includes an aperture through which electrons are passed from the electron source to the target surface to generate x-rays. Moreover, the shield structure provides an electron collection surface, that prevents electrons that rebound from the target surface from re-striking the target.

In a preferred embodiment, at least one fluid passageway is formed within the shield structure. The fluid passageway receives coolant from the reservoir from an inlet port, which then passes through the passageway so as to absorb heat generated in the shield structure, including heat generated as a result of rebounding electrons striking inner surfaces of the shield.

Preferred embodiments of the cooling system also include a plurality of extended surfaces, or cooling fins, that are affixed to the outer surface of the shield structure. Coolant exiting the fluid passageway is allowed to flow across the extended surfaces, which are oriented in a manner so as to conduct heat from the shield to the coolant.

In one preferred embodiment, the cooling system also includes means for augmenting the heat transfer capability of the fluid passageway. In an illustrated embodiment, this means is comprised of a coiled spring that is disposed within the fluid passageway. The spring provides an extended surface that increases the efficiency and rate at which heat is removed by convection from the shield structure.

In another preferred embodiment, the fluid passageways that are formed within the shield structure are oriented in a manner that permits coolant to flow through a first and a second section of the shield structure. Moreover, the passageways are further oriented such that the heat is transferred away from the first section at a greater rate than in the second section. In this way, those sections (i.e., the first section) having a higher thermal content are cooled at a faster rate than those sections (i.e., the second section) having a lower thermal content. This ensures a more efficient and evenly distributed dissipation of heat, and also helps ensure that the coolant is not overly thermally stressed.

Embodiments of the invention also are disclosed that provide a more structurally sound x-ray tube assembly, and that is thus better able to withstand the thermal and mechanical stresses present in an operating tube. For instance, an improved braze joint is provided between the shield structure and the x-ray tube housing. In particular, a braze material is placed along a joint formed along both a horizontal and a vertical surface of the shield structure and the x-ray tube housing. This ensures a connection joint that is more structurally sound, and that is able to survive the varying temperatures, and resultant stresses imposed during operation of the tube.

BRIEF DESCRIPTION OF THE DRAWINGS

In order to more fully understand the manner in which the above-recited and other advantages and objects of the invention are obtained, a more particular description of the invention will be rendered by reference to specific embodiments thereof which are illustrated in the appended drawings. Understanding that these drawings depict only typical embodiments of the invention and are not therefore to be considered to be limiting of its scope, the invention in its presently understood best mode for making and using the same will be described and explained with additional specificity and detail through the use of the accompanying drawings in which.

DETAILED DESCRIPTION OF THE PREFERRED EMBODIMENTS

Reference will now be made to the figures, wherein like structures will be provided with like reference designations. It is to be understood that the drawings are diagrammatic and schematic representations of presently preferred embodiments of the present invention and are not limiting of the present invention, nor are they necessarily drawn to scale.

Figure 1:
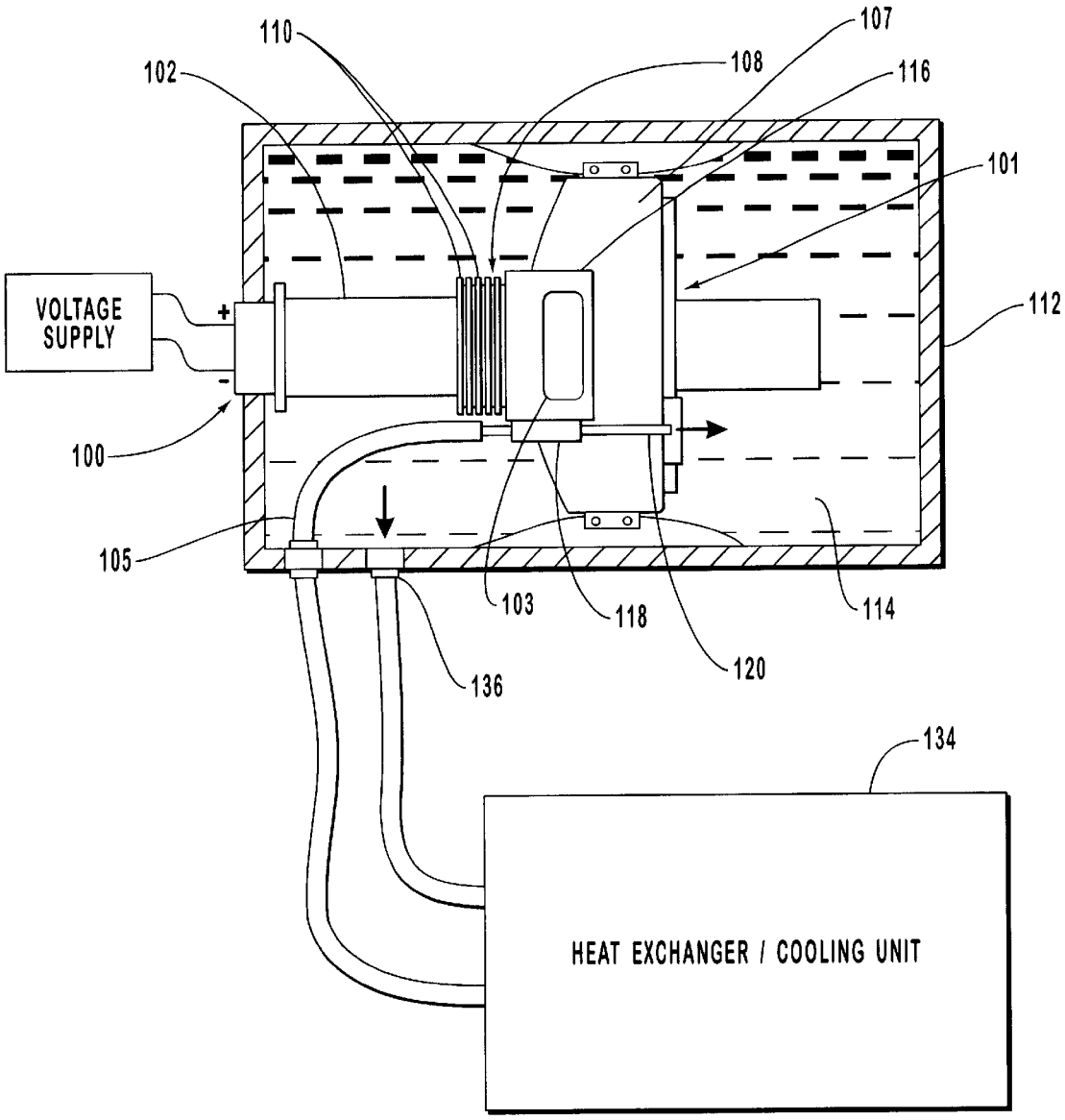
FIG. 1 is a plan view of one preferred embodiment of the cooling system.
Figure 2:
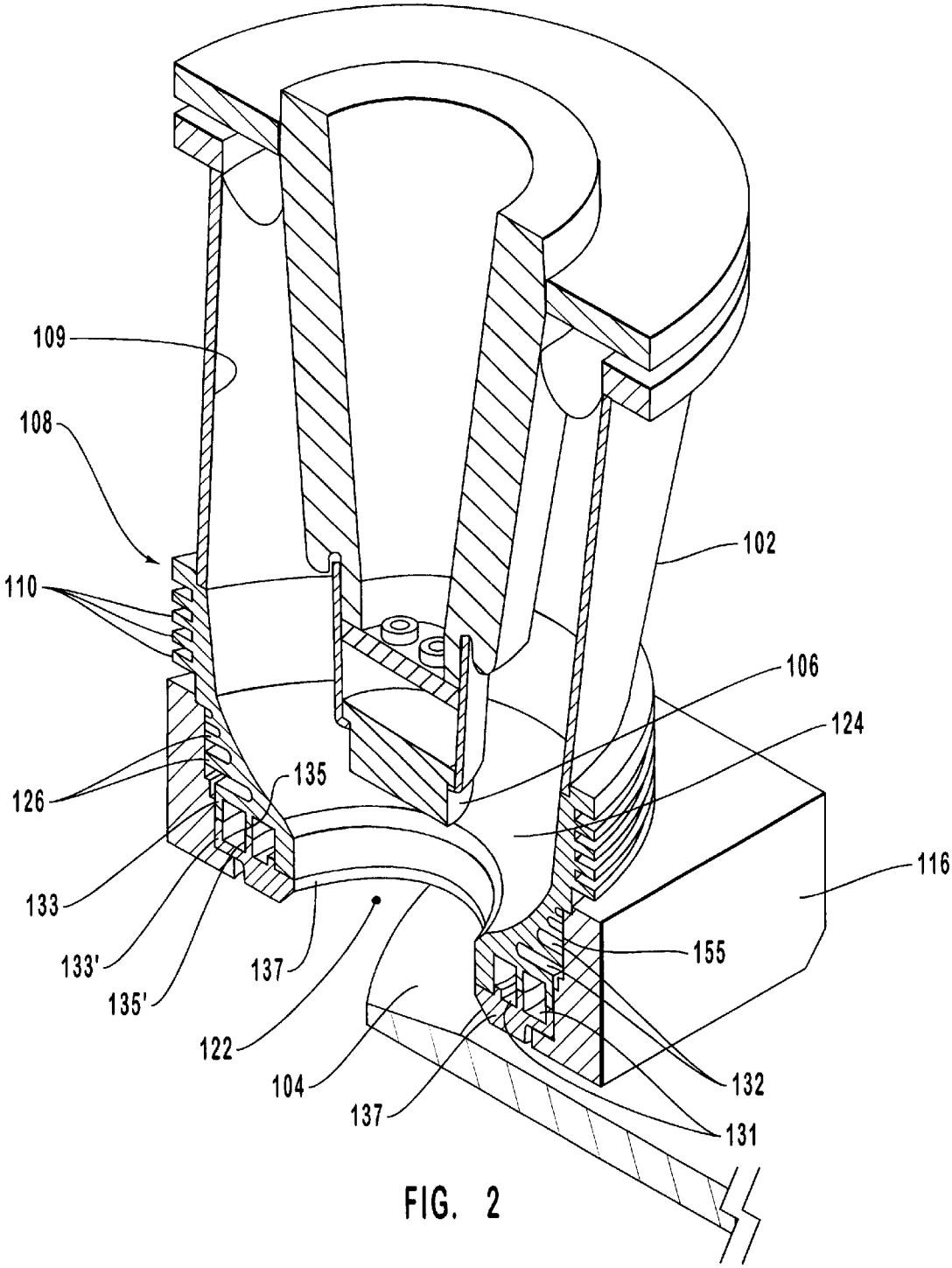
FIG. 2 is an isometric cross-section view of an embodiment of the cathode cylinder and finned shield structure depicted in FIG. 1.

Referring first to FIGS. 1 and 2 together, the relevant portions of an x-ray tube device is depicted generally at 100. An x-ray tube, designated generally at 101, is formed generally with an evacuated envelope housing that is typically referred to as a "can" 107. The evacuated envelope, or can, 107 is disposed within a housing 112. Disposed within the x-ray tube evacuated envelope 107 is an electron source in the form of a cathode head 106, filament (not shown) and associated electronics (not shown), that is disposed within a cathode cylinder 102. Adjacent to the cathode 106, and attached to the end of cathode cylinder 102, is a electron collection device, sometimes referred to as an "aperture," and referred to herein as a shield structure 108. Also disposed within the x-ray tube 101 is a rotating target anode 104, which is axially disposed opposite to the cathode 106. A voltage source is connected to the anode and the cathode, and electrons emitted by the cathode 106 are accelerated when a voltage difference is applied between the cathode and anode. As the high velocity electrons stream towards the anode, they pass through an aperture 122 formed within the shield structure 108. When the electrons impact the surface of the target anode 104, a portion of the kinetic energy is converted to x-rays. These x-rays arc then partially collimated and emitted through a window 103 (FIG. 1) formed in the side of the x-ray tube 101, and a corresponding window in the housing 112 (not shown).

As previously noted and as will be discussed in further detail-below, some of the electrons that strike the target anode surface 104 are not converted into x-rays. Instead, they may rebound from the target anode 104. As will be discussed further below, the shield structure 108 functions so as to prevent the rebounding electrons from descending and re-striking the target anode 104—and thereby generating off-focus x-rays. In addition, some of the rebounding electrons will strike the inner surface of the cathode cylinder 102. While these rebounding electrons are thus prevented from re-striking the target anode 104, they are still traveling at relatively high velocities and thus still generate large amounts of heat within the shield structure 108 and the cathode cylinder 102 when they strike those structures. Consequently, this heat, in addition to the heat generated at the target anode 104, must be continuously removed away from the x-ray tube 101, or damage to the device may occur. As noted, excessive heat in the shield structure and the cathode housing can be especially problematic, especially over time.

FIG. 1 illustrates how in one presently preferred embodiment, the x-ray tube 101 is completely immersed within a liquid coolant 114 that is disposed within the reservoir formed by the housing 112. During operation of the x-ray device, the coolant is re-circulated though the housing 112 via a pump/cooling unit 134. As the coolant is circulated through the housing 112, heat is dissipated from the x-ray tube components and absorbed by the coolant. Heated coolant is then circulated to the heat exchanger 134, where heat is removed by any appropriate means, such as a radiative surface or the like. The cooled liquid is then re-circulated back to the housing reservoir.

Figure 10:
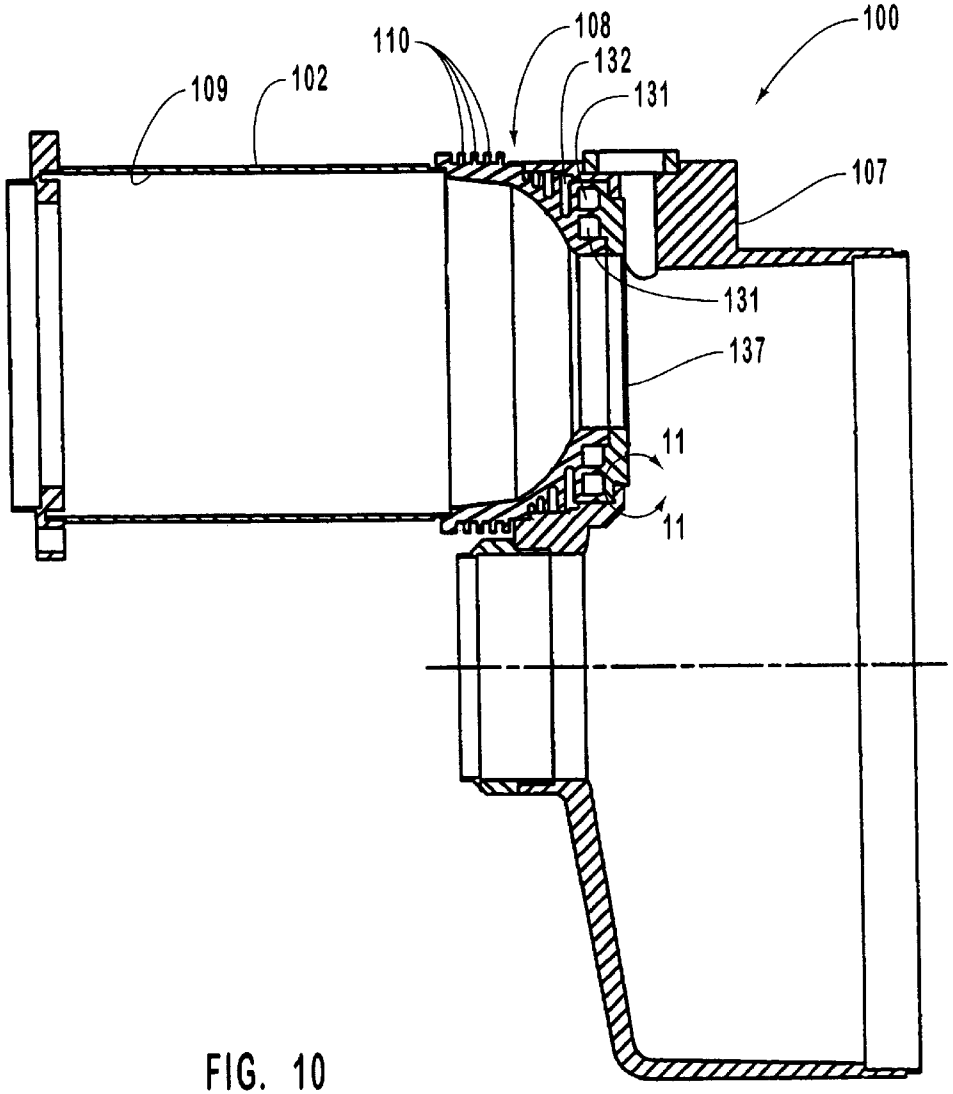
FIG. 10 is a cross-sectional view of a cathode cylinder, shield structure and x-ray tube can assembly.

Generally, the rate of heat transfer is proportional to the surface area across which the heat is transferred. Thus, as noted above, the efficiency at which heat is conducted from the x-ray tube to the coolant is based partly upon the surface area of the component being cooled, which in the past has been limited—especially in the problematic areas of the shield structure and the cathode cylinder 102. Embodiments of the present invention address this problem by way of the shield structure 108, a preferred embodiment of which is shown generally in FIG. 1, and in further detail in FIGS. 2, 3, 4 and 6. As is shown in FIGS. 1, 2 and 10, the shield structure 108 interconnects the main body portion of the evacuated envelope can 107 of the x-ray tube 101 with the cathode cylinder 102. In the illustrated embodiment, the shield structure 108 includes a separate bottom cover, referred to as the aperture disk 137 (shown in FIGS. 2 and 8), that is affixed to the bottom of the shield 108. The disk 137 is in turn affixed to a corresponding recess 155 formed within the can 107. Preferably, the attachment is accomplished with a braze joint, which is described in further detail below. In a presently preferred embodiment, the shield 108 and the aperture disk 137 are each constructed of a aluminum oxide dispersion strengthened copper alloy, such as the material known by the tradename Glidcop AL-15 UNS C-15715 and sold by OMG Americas Inc. Other materials could also be used, including but not limited to Glidcop AL-25, and Glidcop AL-60 UNS C-15725 and UNS C-15760 respectively.

Figure 3:
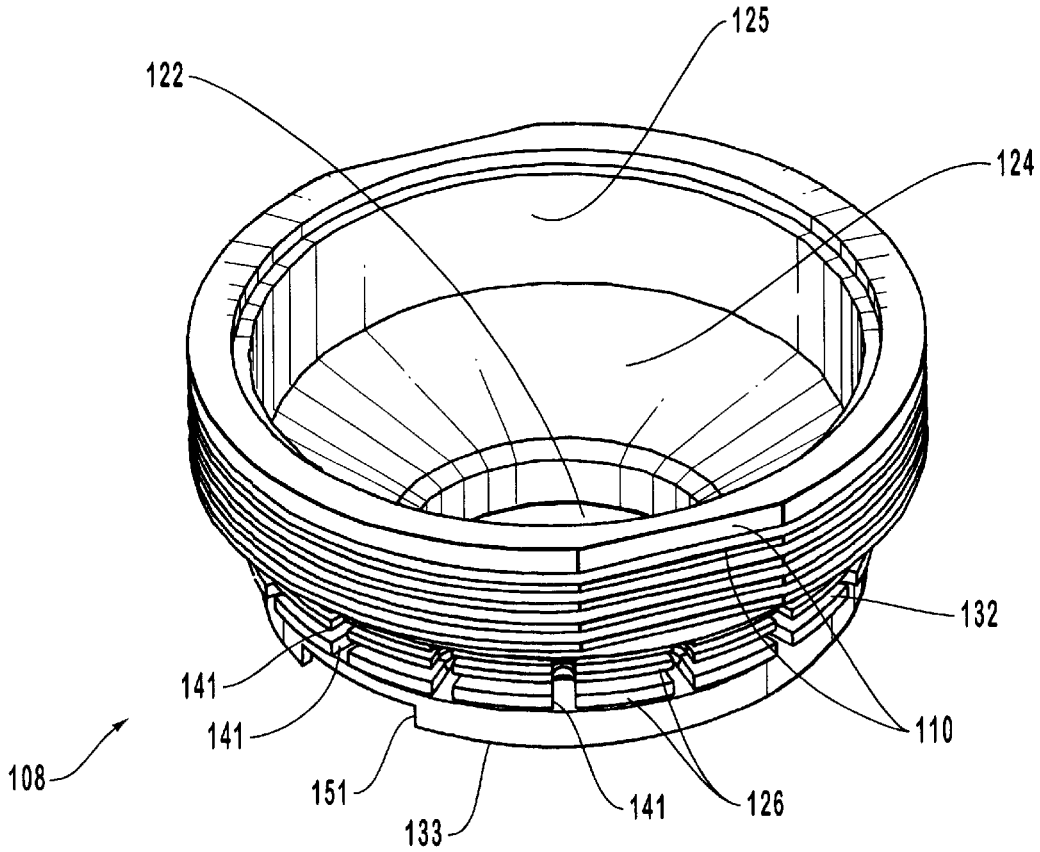
FIG. 3 is an isometric view of one presently preferred embodiment of the shield structure.
Figure 4:
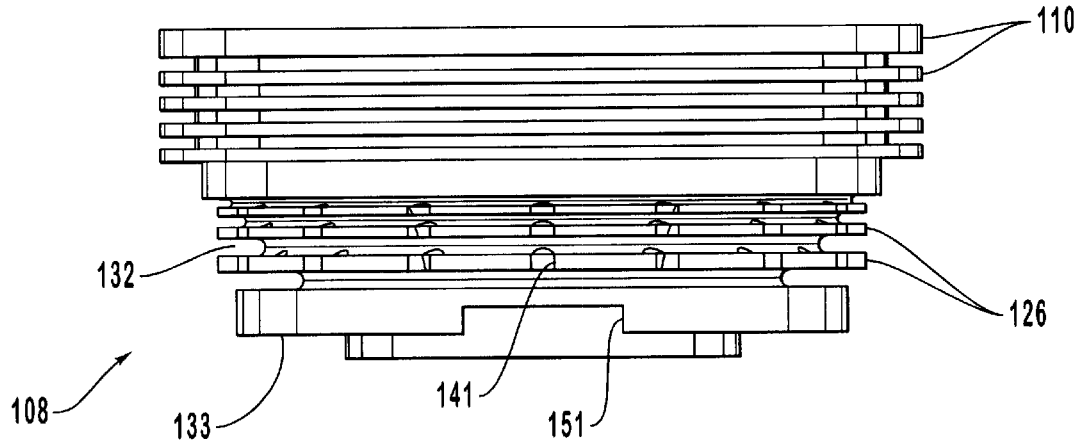
FIG. 4 is a side view of the shield structure in FIG. 3.

As is best seen in FIGS. 2 and 3, the shield structure 108, as well as the aperture disk 137, has an aperture or opening 122 that allows the electron stream to pass from the cathode 106 to the target anode 104 (FIG. 2). Also, disposed about the aperture 122 is a rebounding electron collection surface 124, which provides the function of preventing rebounding electrons from descending and re-striking the target anode 104. The electron collection surface 124 is shaped and oriented in a manner such that the trajectory of rebounding electrons will cause them to strike the collection surface 124 instead of returning to the anode target surface 104. In the illustrated embodiment, the surface 124 is sloped towards the aperture 122 with a concave shape. It will be appreciated that other shapes and contours could be used.

In a presently preferred embodiment, the shield structure includes a means for transferring heat away from the shield structure. By way of example and not limitation, in one preferred embodiment the heat transfer means is comprised of a plurality of cooling members or "fins," which are designated at 110 in FIG. 1 and are shown in further detail in FIGS. 2, 3, 4 and 6. These cooling fins 110 are comprised of adjacent annular extended surfaces formed about the periphery of the outer surface of the shield structure 108, and are at least partially exposed to the reservoir coolant 114, as is indicated in FIG. 1. In general, the fins 110 effectively increase the amount of surface area of the shield 108 that is in contact with the reservoir coolant, and they thereby function to increase the efficiency and rate at which heat is conducted and transferred from the shield to the coolant. This can best be seen in the perspective view of a preferred shield structure 108 in FIG. 3, and in the side elevation view of FIG. 4. As is illustrated, the plurality of cooling fins I 10 are formed about the entire outer surface of the shield 108, and are spaced apart so as to permit coolant to flow between the fins and thereby maximize the surface area exposed to the coolant. In this way, heat generated at the collection surface 124, the inner surface 125 of the shield, or at the inner surface 109 (FIG. 2) of the cathode cylinder 102 from rebounding electrons can be conducted to the fins 110 and then more efficiently transferred to the coolant 114. Thus, the fins 110 are particularly useful in facilitating heat transfer by convection from the areas of the shield structure 108 and the cathode cylinder 102 to the coolant 114, thereby reducing the damaging thermal effects of the rebounding electrons.

The enhanced cooling effect provided by the fins improves the operational life of the x-ray tube in other ways. By conducting relatively more of the shield structure 108 heat to the coolant, the fins 110 reduce the heat load imposed on the coolant that is circulated through coolant passages formed in the shield (described below). In other words, the fins 110 serve to more efficiently redistribute the heat conducted from the shield structure 108. In a preferred embodiment, the cooling effect produced by the fins results in a reduction of about 7 percent to about 9 percent in the heat load imposed on the circulating coolant. Because the heat load on the circulating coolant is reduced, the circulating coolant is substantially less likely to experience thermal breakdown. The benefit is a longer lasting and more reliable x-ray tube device.

While a preferred embodiment of this invention employs fins to increase the overall rate of heat transfer from the shield structure, and thus from the x-ray tube, it is recognized that an increase in the surface area by use of alternative structures or elements of the exposed surfaces of the shield can be used to cause a rise in the rate at which heat is transferred to the reservoir coolant. Furthermore, while cooling fins integral with the shield structure represent a preferred embodiment, this invention also contemplates discrete cooling fins, or a cooling fin structure that is separately attachable to the shield structure and/or the cathode cylinder, or similar arrangements.

Figure 5:
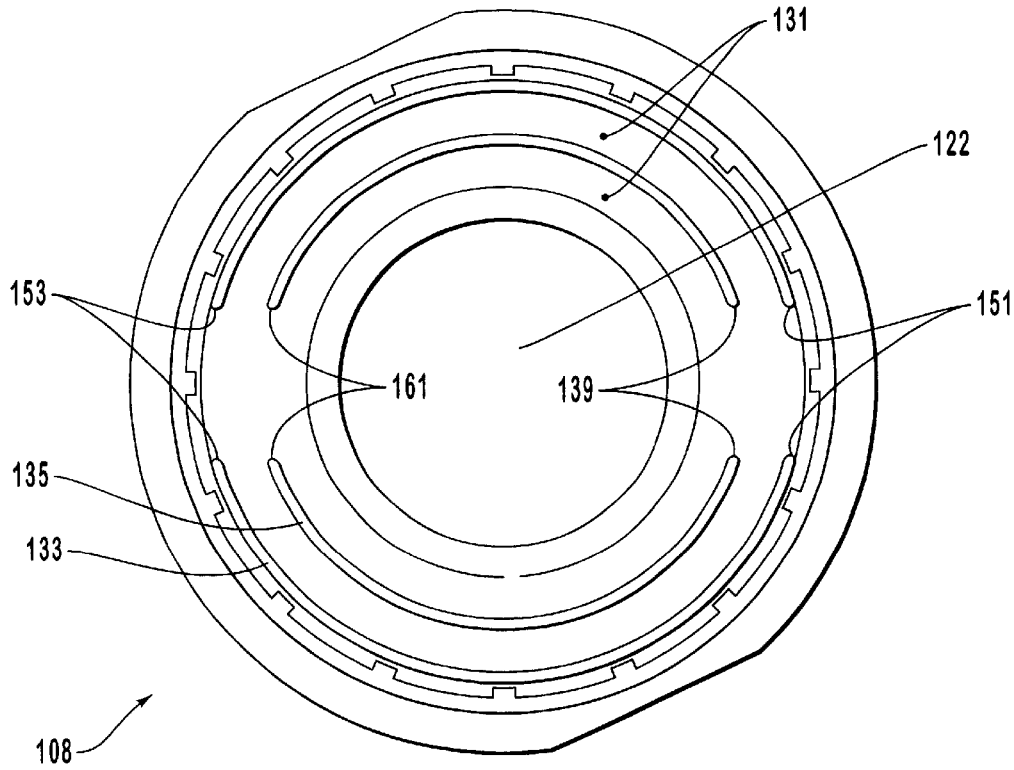
FIG. 5 is a plan view of the shield structure.
Figure 6:
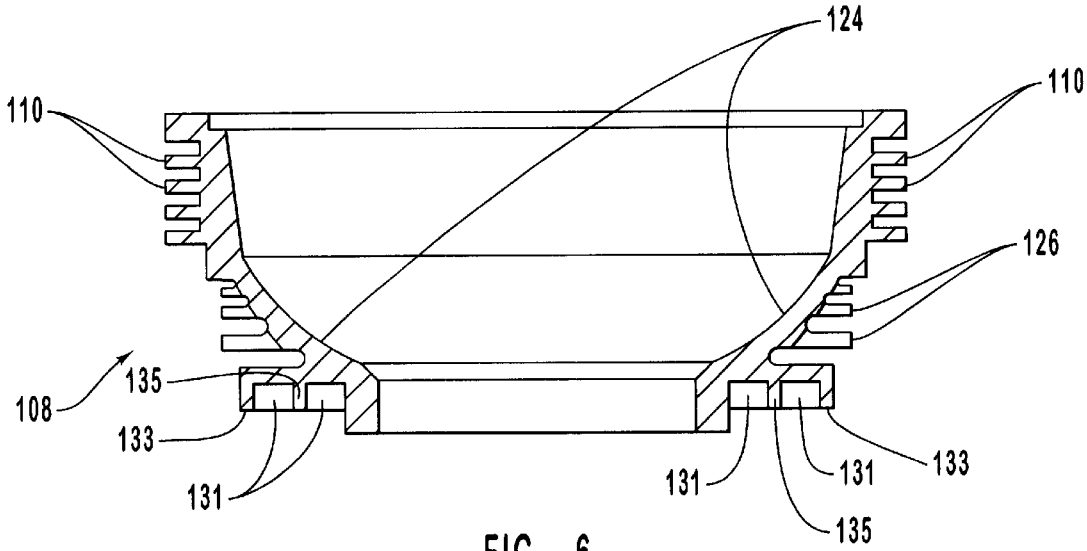
FIG. 6 is a cross-sectional view of the shield structure depicted in FIG. 3.

In a preferred embodiment, the cooling system of the present invention also includes additional fluid passageways that are placed substantially proximate to the sources of heat, and which thereby function so as to further assist in the removal of heat generated within the x-ray tube during operation—especially in the area of the shield structure 108. In the illustrated embodiment, these internal fluid passageways, denoted at 131 and 132 in FIG. 2, are formed in two ways. First, a plurality of passageways 131 are formed in the bottom half section of the shield structure 108. These passageways 131 can be formed directly and integrally within the body of the shield 108 (i.e., in the form of a hollow bore), or, as is the case with the illustrated embodiment, can be formed by forming channels with spaced apart ridges 133 and 135 in the bottom of the shield 108 (FIGS. 5 and 6). As is shown in the FIG. 2 embodiment, a separate bottom cover, referred to as the aperture disk 137, is affixed to the bottom of the shield 108. The aperture disk 137 is then affixed, preferably via a braze joint (an embodiment of which is described below), to a recess 155 formed in the can 107. The aperture disk 137 has a corresponding aperture 122, as well as complementary ridges, designated at 133' and 135' in FIG. 2 (also shown in FIG. 8), that abut against the ridges 133, 135 on shield 108, thereby forming the passageways 131 when the disk 137 is mated with the shield 108. In the illustrated embodiment, both fluid passageways labeled as 131 are in fluid communication with one another by virtue of gaps formed in circular ridge 135, as is illustrated in FIG. 5 (also shown in FIG. 8).

A second set of passageways 132 are formed around the outer periphery of the shield 108. These are formed with a plurality of spaced apart cooling surfaces 126, also in the form of ridges, that, when inserted within the recess 155 of can 107/manifold 116 abut against the inner surface of the recess 155 and thereby form individual passageways 132. FIG. 3 illustrates how each of the passageways 132 are in fluid communication with one another due to gaps 141 formed between adjacent ridges 126. In addition, in a preferred embodiment, the passageways 131 and 132 are placed in fluid communication with one another in a manner described below. As will also be described in further detail, during operation of the x-ray tube, coolant is recirculated throughout these passageways so as to remove heat by convection from the shield structure 108.

Referring again to FIG. 1, it is shown how in one presently preferred embodiment the coolant 114 is supplied to the housing 112 via a conduit 105 disposed within the housing 112 reservoir. The conduit 105 is connected to a manifold inlet/outlet connection 118 that is affixed, or formed integrally with, a coolant manifold 116 that is disposed on, or formed as an integral part of, the evacuated housing 107 of the x-ray tube 101. The coolant manifold 116 forms a fluid communication path between the inlet conduit 105 and the fluid passageways 131 via an inlet port hole formed in the manifold (not shown). In a preferred embodiment, this is done by orienting the shield 108 within the manifold 116 such that a gap 151/151' formed in abutting ridges 133/133' is aligned with the inlet port hole so as to receive incoming coolant from inlet conduit 105. Coolant is thus allowed to flow into passageways 131. As the coolant enters passageway 131, it splits into two flows, where each flow circulates in opposing azimuthal directions. Of course, as the coolant proceeds through the passageway 131, heat is transferred to the coolant from the shield structure.

In the preferred embodiment, passageway 131 is placed in fluid communication with passageway 132. This is accomplished by providing another gap 153 (FIG. 5) in ridge 133 at a point opposite to gap 151 (as well as corresponding gaps in the aperture disk, shown in FIG. 8). A cavity (designated in FIGS. 12A and 12B at 200) is formed within the interior wall of recess 155. This cavity 200 is aligned with the gap 153, and is sufficiently large so as to place passageway 131 in fluid communication with at least one of the passageways 132. Thus, in this example embodiment, two coolant flows proceed through passageway 131 and then converge at the opposite side of the shield 108. The coolant then continues to flow into the cavity 200 via gap 153/153', and then into the upper half of the shield 108 via the passageways 132. Again, the coolant splits and the two flows traverse the upper half of the shield 108. Also, as in the lower half, the coolant is heated as it flows over the shield and the surfaces 126.

Also formed within manifold inlet/outlet connection 118 is an outlet port hole (not shown) that is in fluid communication with passageway 132. As the two flows of coolant traverse the upper half of shield 108, the flows converge and then exit at the outlet port hole, which is in fluid communication with an outlet conduit 120. In FIG. 1, the outlet conduit is in fluid communication with the reservoir, as is indicated by the fluid flow line. It will be appreciated that in certain x-ray tube configurations, another manifold may be used to direct the coolant to other cooling passages formed within other areas of the x-ray tube to effect additional heat removal by convection, before being discharged into the reservoir.

Once discharged into the reservoir 112, the coolant flows over the external surfaces of the x-ray tube, including the fin surfaces of the shield 108 as previously described, and cools by convection. Ultimately, the coolant exits the reservoir 112 at reservoir discharge connection 136, and flows back to the external heat exchanger to repeat the cycle, as is illustrated in FIG. 1. Thus, the convective heat transfer effected by the fins 110 complements the heat transfer achieved through convective cooling in the coolant passages 131, 132, and thus serves provides a relative increase in the overall rate of heat transfer from the shield structure 108.

It will be appreciated that other arrangements may be used for providing coolant to the passageways 131, 132 could be utilized. For instance, although the inlet port conduit is connected to passageway 131, and the outlet port to passageway 132, an opposite arrangement could be used. Moreover, multiple inlet ports and/or multiple outlet ports could also be utilized and, as noted, additional manifolds could be used to direct the coolant to other areas of the x-ray tube. Also, one of skill in the art will recognized that different arrangements could be utilized for placing the passageways 131 and 132 in fluid communication.

Figure 12B:
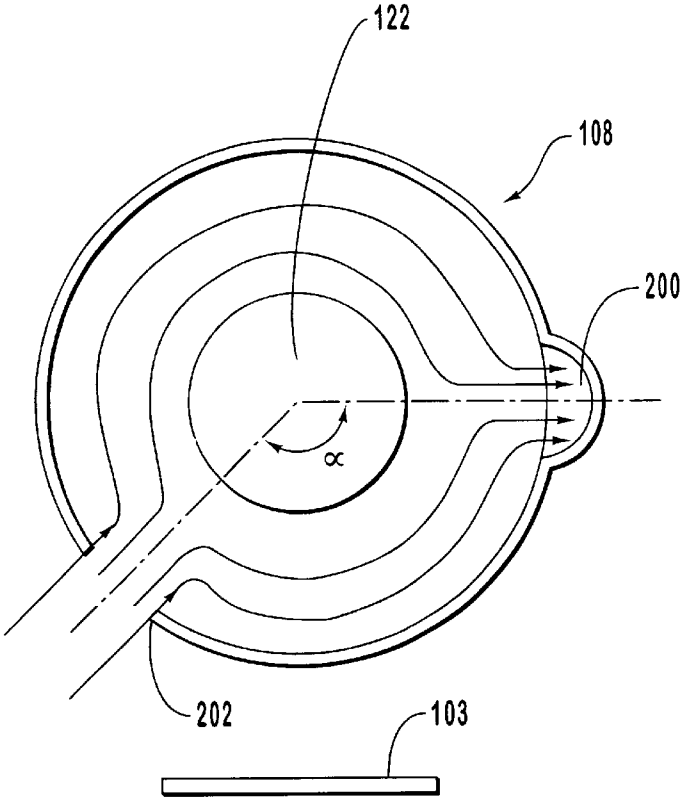
FIG. 12B is a schematic representation illustrating an alternative arrangement for fluid flow through the lower half of the shield structure.
Figure 12A:
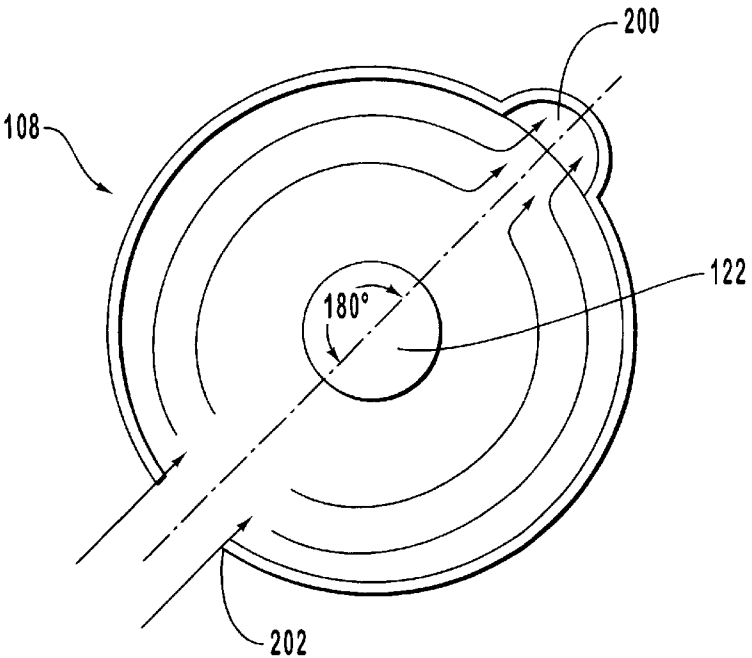
FIG. 12A is a schematic representation illustrating the fluid flow through the lower half of the shield structure.

In addition, the relative orientation of the fluid inlet port from the manifold 116 to the passageways 131 in the lower half of the shield 108 may be varied. In the description above, it was noted that the fluid inlet port (202 in FIG. 12A) is positioned directly opposite to, i.e., along a 180 degree angle, the point at which the coolant enters the upper half of the shield 108 and passageways 132. This flow scheme is schematically represented in FIG. 12A, where coolant enters the lower half of the shield 108 via inlet port 202, then splits into two flows that each circulate in opposing azimuthal directions. The two flows then converge at the cavity 200, where it enters the upper half of the shield 108 via passageways 132. With this type of setup, the flow rate of the two flows is approximately equal, and thus the rate of heat transfer is approximately equal.

However, as noted, heat within the shield 108 is non-uniform. Namely, the side of the shield that is more proximate to the x-ray window 103 is typically subjected to higher temperatures than the opposite side. This is due to the effect imposed by the target angle on the back scattered electrons, i.e., more electrons hit the window side of the electron collection surface 124 than the centerline side. As such, in another preferred embodiment, the flow rate is increased in that portion of the shield having a higher thermal content (i.e., the side more proximate to the window 103), which thereby increases the rate of heat removal. In one embodiment, the is accomplished by varying the relative orientation of the inlet port 202 with respect to the passageways 131. This particular arrangement is represented in FIG. 12B. As is shown, an angle of less than 180 degrees is used to orient the inlet port 202 with the passageway 131 and the cavity 200 on the side proximate to the x-ray window 103. This decrease in relative travel distance increases the coolant flow rate, thereby increasing the convective heat transfer coefficient on that side and decreasing the shield's temperature gradient in the azimuthal direction. Consequently, the heat transfer rate on the window side is increased. Conversely, the heat transfer is decreased on the remaining side of the shield 108.

Increasing the rate of heat transfer can be accomplished with other approaches as well. For instance, in the side proximate to the window 103 (or whatever portion has higher thermal content), the flow area cross section of the passageway 131 could be increased, and the passageway disposed in the opposite/remaining portion of the shield decreased. This would increase the volume of coolant flow through the portion of the shield having a higher thermal content, and thus increase the rate of heat transferred by convection.

Figure 7:
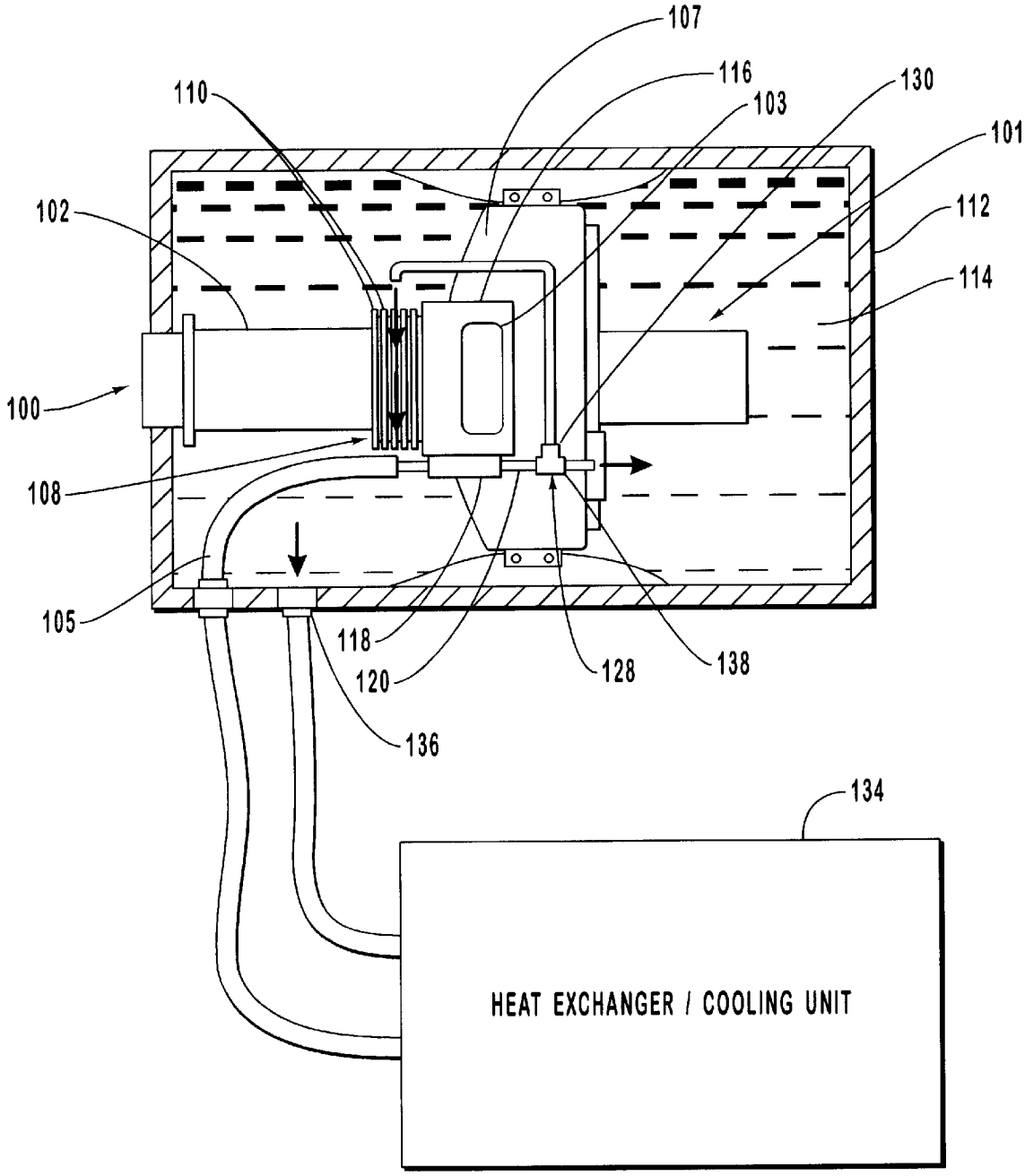
FIG. 7 is a plan view of an alternative embodiment of the cooling system.

Reference is now made to FIG. 7, which illustrates a presently preferred alternative embodiment of a cooling system. There, the coolant manifold 116 operates in conjunction with external fins 110 to facilitate an enhanced convective cooling of the shield structure 108, and thus, of the x-ray tube 100 as a whole. Specifically, a coolant flow is generated by a cooling unit 134 as previously described, and coolant flows through inlet conduit 105, into the coolant manifold 116, and into passageways 131 and 132 in the manner previously described. However, instead of discharging the coolant directly into the reservoir as described in FIG. 1, the output conduit 120 is connected to a flow diverter, designated at 128, which splits the coolant into two discharge streams. One of the coolant streams from the flow diverter 128 is discharged to the reservoir 112 through coolant outlet port 138 (or, optionally, into another manifold where it can be directed to other areas of the x-ray tube, as previously noted). The other coolant stream from the flow diverter 128 is discharged through coolant outlet port 130 and the flow is specifically directed across fins 110. This directed flow more efficiently removes heat from the fins 110. As in FIG. 1, the coolant eventually exits the reservoir at the reservoir discharge connection 136 and flows back to the cooling unit 134 to repeat the cycle.

The alternative embodiment of FIG. 7 enhances cooling of the x-ray tube by: i) providing cooling fins 110 to increase the surface area of the x-ray tube, and in particular the shield 108, thereby increasing the rate of convective heat transfer from the x-ray tube structures to the reservoir coolant; ii) directing a portion of the manifold coolant discharge across the fins to increase convective heat transfer from the fins, thus augmenting the convective cooling effect of the fins; and iii) convectively cooling the interior of the shield structure. The combined effect of the internal cooling passages, external fins, and dual discharge manifold is to significantly increase the rate at which heat is removed from the x-ray tube. The enhanced heat transfer rate serves to reduce x-ray tube operating temperatures and thus the resultant thermal mechanical stresses, and substantially prevents thermal breakdown of the coolant, thereby extending the life of the coolant and, accordingly, the x-ray tube.

It will be appreciated that while the aforementioned preferred embodiment teaches a dual outlet flow diverter, it should be recognized that a flow diverter with multiple outlets could be utilized. Accordingly, an x-ray tube cooling system employing a multiple outlet (i.e., greater than two) flow diverter is contemplated as being within the scope of the present invention.

Figure 9A:
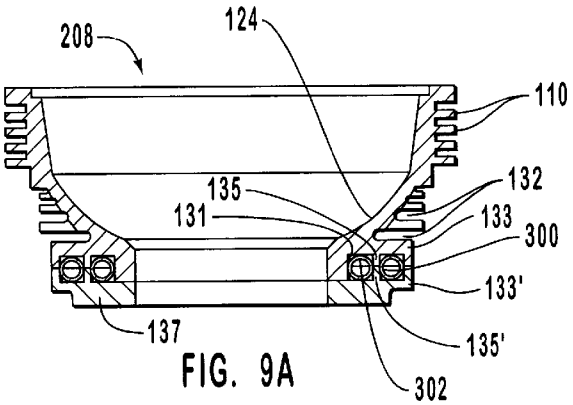
FIG. 9A is a cross-sectional view of the assembled shield structure of FIG. 8.
Figure 9B:
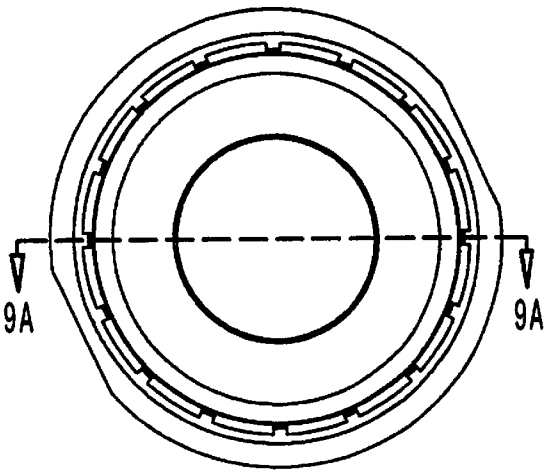
FIG. 9B is a plan view of the shield structure of FIG. 8.
Figure 8:
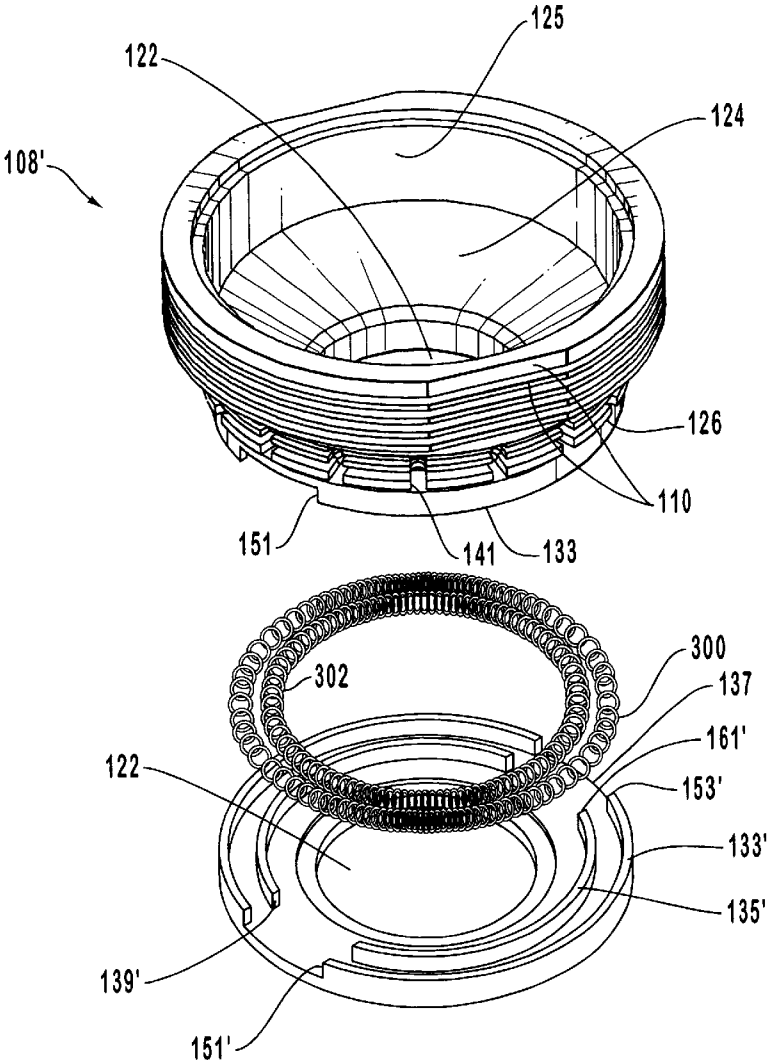
FIG. 8 is an exploded perspective view of another presently preferred embodiment of a shield structure.

Reference is next made to FIGS. 8 and 9A–9B, which together illustrate another embodiment of a shield structure, designated generally at 108'. The shield 108' is similar to the shield 108 described previously, and the discussion for like elements will not be repeated. Also shown is the aperture disk 137, along with ridges 133' and 135' that mate with corresponding ridges 133 and 135 formed on the bottom of shield 108' so as to form fluid passageway 131. The embodiment of FIG. 8 differs from that of FIGS. 1–7 in one primary respect. Namely, the shield assembly 108' includes means for augmenting the heat transfer capability of the coolant passageway. By way of example, one structure for performing this function is a coiled wire, designated in FIG. 8 at 300 and 302, that is disposed within each fluid passageway 131. The cross-sectional side view of FIG. 9A illustrates the coiled wires 300, 302 disposed within the fluid passageways 131. The coiled wires 300, 302 are comprised of a thermally conductive material material, such as copper or an aluminum oxide dispersion strengthened copper alloy of the sort used in the shield. Each turn of the coiled wire can have either a circular or noncircular cross section and, optionally, can have non-uniform diameter/thickness. Turns of the coiled wire can be secured to the interior wall of the fluid passageway by brazing, or similar attachment means, which also can increase thermal conduction. Each coil augments the heat transfer rate provided by coolant within the passageway 131. In particular, the presence of the coiled wire adds additional surface area within the passageway, which thereby facilitates the transfer of heat. In addition, the coil breaks the boundary layers of coolant as the coolant passes over the coils within the passageway. This promotes turbulence, and further improves heat transfer. Moreover, because of the gaps (shown at 139'/161' and 151'/153' in disk 137 of FIG. 8) formed in the passageways 131, coolant flows both parallel and perpendicular to the axes of the coil wires 300, 302. This further increases the rate and efficiency at which heat is transferred away from the shield 108'.

It will be appreciated that other structures could be used to provide this heat transfer augmentation function. Essentially any structural component that provides an extended heat transfer surface within the passageway could be used. For instance, a twisted tape, copper foil type element could be used. Also, wire orientations other than the coil arrangement illustrated could be used.

Figure 11:
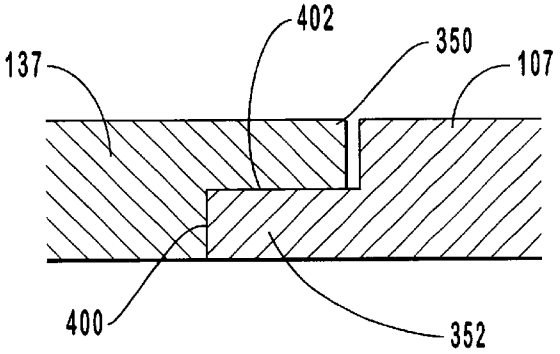
FIG. 11 is a detail view taken along lines 11—11 in FIG. 10, showing the braze joint configuration between the aperture disk and the x-ray tube can.

As noted above. the excessive temperatures present in the area of the shield and aperture disk assembly cause mechanical stresses that can be especially problematic in areas where two components are attached. These areas are often the most subject to failure. As such, embodiments of the present system are directed to addressing this problem, especially where the shield 108 and the aperture disk 137 to the x-ray tube can 107. In particular, an improved braze joint configuration between the aperture disk 137 and the can 107 is provided. Instead of providing a joint that is brazed only on a horizontal surface, as is common in the prior art, the aperture disk is brazed to the can on both a horizontal as well as a vertical surface. Preferred embodiments of this brazing arrangement are shown in FIGS. 10 and 11, to which reference is now made.

FIG. 10 is a simplified view of a cathode cylinder 102 affixed to a shield 108 and aperture disk 137 assembly, which is in turn affixed to the x-ray tube can 107. FIG. 11 is an exploded view taken along lines 11—11 in FIG. 10, which illustrates one presently preferred embodiment of the braze joint between the can 137 and the aperture disk 137. As is shown, the aperture disk 137 includes a shoulder region 350 that projects outwardly around the disk 137 periphery. The can 107 includes a correspondingly shaped shoulder region 352 that mates with that of the disk 137. In particular, it is shown how the two shoulder regions together form a horizontal mating region at 402, as well as a vertical mating region 400. These two regions can be brazed together. The arrangement is particularly advantageous in that it decreases the stresses between the disk 137 and the can 107 by factors of six or more in preferred embodiments, when compared to joint arrangements having a braze only along a horizontal surface. As such, the improved braze joint better resists stresses associated with the extreme temperatures of the x-ray tube, resulting in a device that is less subject to failure and that provides a longer overall operational life.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An x-ray tube comprising:

(a) a cathode cylinder having an electron source disposed therein;

(b) an x-ray tube housing having an anode disposed therein, the anode having a target surface capable of receiving electrons emitted by the electron source;

(c) a shield structure positioned between the cathode cylinder and the x-ray tube housing, the shield structure having an aperture formed therein through which the electrons are passed from the electron source to the target surface;

(d) at least one fluid passageway disposed proximate to the shield structure, wherein the at least one fluid passageway allows a coolant to pass through and thereby absorb heat from at least a portion of the shield structure, and wherein at least a portion of the at least one fluid passageway is formed by attaching a main body portion of the shield structure to an aperture disk; and (e) a plurality of extended surfaces affixed to an outer surface of the shield structure, the extended surfaces being at least partially in contact with the coolant that has passed through the at least one fluid passageway, and the extended surfaces being oriented so that heat is transferred from the shield structure to the coolant.

2. The x-ray tube according to claim 1, wherein the extended surfaces are comprised of a plurality of adjacent annular fin elements, each annular fin being disposed about the outer periphery of the shield structure.

3. The x-ray tube according to claim 1, further comprising means for augmenting the heat transfer capability of the fluid passageway.

4. The x-ray tube according to claim 3, wherein the means for augmenting is comprised of a coiled wire disposed within the at least one fluid passageway.

5. The x-ray tube according to claim 1, wherein the at least one fluid passageway is formed as a fluid passageway formed within a side of the shield structure.

6. The x-ray tube according to claim 5, wherein the fluid passageway formed within the side of the shield structure is formed between adjacent heat dissipation elements formed about the outer periphery of the shield structure when the shield structure is operably affixed to x-ray tube housing.

7. The x-ray tube according to claim 1, wherein the at least one fluid passageway comprises at least one fluid passageway formed within a bottom section of the shield structure, and at least one fluid passageway formed within a side of the shield structure.

8. The x-ray tube according to claim 7, wherein the fluid passageway formed within the bottom section of the shield structure, and the fluid passageway formed within the side of the shield structure are in fluid communication.

9. The x-ray tube according to claim 1, wherein the plurality of extended surfaces are formed integrally with the shield structure.

10. The x-ray tube according to claim 1, wherein the at least one fluid passageway permits coolant to flow through a first section and a second section of the shield structure, and in a manner so that heat is transferred away from the first section at a greater rate than in the second section.

11. The x-ray tube according to claim 1, further comprising a fluid flow conduit that directs at least a portion of the flow coolant that has passed through the at least one fluid passageway directly across at least a portion of the plurality of extended surfaces, whereby heat is transferred from the extended surfaces to the directed coolant.

12. The x-ray tube according to claim 1, wherein the shield structure and the extended surfaces is comprised of an aluminum oxide dispersion strengthened copper alloy.

13. The x-ray tube according to claim 1, wherein the shield structure is affixed to the x-ray tube housing with a braze material placed along a joint formed along both a horizontal and a vertical surface of the shield structure and the x-ray tube housing.

14. An x-ray tube cooling system comprising:

(a) a reservoir containing coolant that is continuously circulated through the reservoir by an external cooling unit;

(b) a shield structure having an aperture that allows electrons to pass from an electron source to a target anode and that prevents electrons that rebound from the target anode from restriking the anode target;

(c) a coolant manifold having an inlet and an outlet port, the inlet port receiving coolant from the cooling unit;

(d) at least one passageway formed within the shield structure, wherein the at least one passageway receives coolant from the inlet port and discharges the coolant at the outlet port, the coolant thereby absorbing heat from the shield structure, and wherein at least a portion of the at least one passageway is formed by attaching a portion of the shield structure to an aperture disk;

(e) a plurality of adjacent extended fin surfaces that are disposed about the outer periphery of the shield structure, and wherein the outlet port directs at least a portion of the coolant passed through the passageway to flow across the surfaces of the fins, and thereby increase the rate of heat transferred from the shield to the directed coolant; and (f) means for augmenting the heat transfer capability of the at least one fluid passageway.

15. The x-ray tube cooling system according to claim 14, wherein the means for augmenting is comprised of an element having an extended heat transfer surface that is disposed within the at least one fluid passageway.

16. The x-ray tube cooling system according to claim 14, wherein the at least one fluid passageway permits coolant to flow through a first and a second section of the shield structure, and in a manner so that heat is transferred away from the first section at a greater rate than in the second section.

17. The x-ray tube cooling system according to claim 16, wherein the length of the passageway in the first section is shorter in length than the passageway of the second section, whereby the rate of fluid flow in the first section is greater than the second section.

18. The x-ray tube cooling system according to claim 16, wherein the cross-sectional flow area of the passageway in the first section is greater than the cross-sectional flow area of the passageway in the second section, whereby the rate of fluid flow in the first section is greater than the second section.

19. A method for cooling a shield structure portion of an x-ray tube comprising the following steps:

(a) providing at least a first fluid path and a second fluid path through a corresponding passageway formed within the shield structure;

(b) directing a liquid coolant through an inlet to the first and the second fluid paths;

(c) discharging the liquid coolant from the first and the second fluid paths via a plurality of discharge paths;

(d) directing at least a portion of the discharged liquid coolant across a plurality of extended fin surfaces formed on an outside surface of the shield structure through at least one of the discharge paths;

(e) circulating the liquid coolant through a cooling unit; and (f) repeating steps (b) through (e).

20. The method according to claim 19, wherein the rate of fluid flow through the first fluid path is greater than that of the second fluid path.

21. In an x-ray generating apparatus comprising an evacuated envelope at least partially disposed within a reservoir containing coolant, and the envelope having mounted therein an electron source for generating an electron beam and a spaced apart rotatable anode target, a shield assembly disposed between the electron source and the anode target, the shield assembly comprising:

a main body portion having an aperture formed therein for allowing the electron beam to pass from the electron source to the anode target;

an electron collection surface disposed about the aperture and oriented in a manner so as to face the electron source;

a plurality of adjacent and extended cooling surfaces affixed to an outer surface of the main body portion, the extended surfaces being at least partially in contact with the coolant disposed within the reservoir so that at least a portion of the heat generated at the electron collection surface is transferred to the coolant via the plurality of cooling surfaces; and at least one fluid passageway formed within the main body portion, the passageway having an inlet port for receiving coolant and a plurality of discharge ports wherein at least one of the discharge ports directs the coolant across at least a portion of the plurality of extended cooling surfaces such that heat is transferred from the extended surfaces to the directed coolant.

22. The shield assembly according to claim 21, the at least one fluid passageway permits coolant to flow through a first section and a second section of the main body portion, and in a manner so that heat is transferred away from the first section at a greater rate than in the second section.

23. The x-ray tube according to claim 21, wherein the main body portion and the extended surfaces are comprised of an aluminum oxide dispersion strengthened copper alloy material.

24. The x-ray tube according to claim 21, wherein the main body portion is affixed to the evacuated envelope with a braze material placed along a joint formed along both a horizontal surface and a vertical surface of the main body portion and the evacuated envelope.

25. The shield assembly according to claim 21, further comprising a second plurality of extended cooling surfaces disposed about the outer periphery of the main body portion, the second plurality of cooling surfaces forming at least one fluid passageway when the main body portion is affixed to the evacuated envelope for circulating a portion of the coolant therethrough.

26. An x-ray tube comprising:

(a) a cathode cylinder having an electron source disposed therein;

(b) an x-ray tube housing having an anode disposed therein, the anode having a target surface capable of receiving electrons emitted by the electron source;

(c) a shield structure positioned between the cathode cylinder and the x-ray tube housing, the shield structure having an aperture formed therein through which the electrons are passed from the electron source to the target surface, wherein the shield structure is comprised of an aluminum oxide dispersion strengthened copper alloy;

(d) at least one fluid passageway disposed proximate to the shield structure, wherein the fluid passageway allows a coolant to pass through and thereby absorb heat from at least a portion of the shield structure; and (e) a plurality of extended surfaces affixed to an outer surface of the shield structure, the extended surfaces being at least partially in contact with the coolant that has passed through the at least one fluid passageway, and the extended surfaces being oriented so that heat is transferred from the shield structure to the coolant, wherein the extended surfaces are comprised of an aluminum oxide dispersion strengthened copper alloy.

27. In an x-ray generating apparatus comprising an evacuated envelope at least partially disposed within a reservoir containing coolant, and the envelope having mounted therein an electron source for generating an electron beam and a spaced apart rotatable anode target, a shield assembly disposed between the electron source and the anode target, the shield assembly comprising:

a main body portion having an aperture formed therein for allowing the electron beam to pass from the electron source to the anode target, wherein the main body portion is comprised of an aluminum oxide dispersion strengthened copper alloy material;

an electron collection surface disposed about the aperture and oriented in a manner so as to face the electron source; and a plurality of adjacent and extended cooling surfaces affixed to an outer surface of the main body portion, the extended surfaces being at least partially in contact with the coolant disposed within the reservoir so that at least a portion of the heat generated at the electron collection surface is transferred to the coolant via the plurality of cooling surfaces, wherein the extended surfaces are comprised of an aluminum oxide dispersion strengthened copper alloy material.

* * * * *